US010166688B2

(12) United States Patent
Giro Amigo

(10) Patent No.: US 10,166,688 B2
(45) Date of Patent: Jan. 1, 2019

(54) METHOD FOR OBTAINING ONE OR A NUMBER OF STRIPS OF A BAND MATERIAL AND A CUTTING DIE FOR PUTTING THE METHOD INTO PRACTICE

(71) Applicant: Girnet Internacional, S.L., Badalona (ES)

(72) Inventor: Ezequiel Giro Amigo, Badalona (ES)

(73) Assignee: Girnet Internacional, S.L., Badalona (ES)

( * ) Notice: Subject to any disclaimer, the term of this patent is extended or adjusted under 35 U.S.C. 154(b) by 134 days.

(21) Appl. No.: 15/274,106

(22) Filed: Sep. 23, 2016

(65) Prior Publication Data

US 2017/0095941 A1 Apr. 6, 2017

(30) Foreign Application Priority Data

Oct. 2, 2015 (ES) ..... 201531412

(51) Int. Cl.
*B26D 7/26* (2006.01)
*B26D 1/00* (2006.01)
*B26F 1/38* (2006.01)

(52) U.S. Cl.
CPC ..... *B26D 7/2628* (2013.01); *B26D 1/0006* (2013.01); *B26F 1/384* (2013.01); *B26D 2001/0053* (2013.01)

(58) Field of Classification Search
CPC ..... B26D 7/2628; B26D 1/0006; B26D 2001/0053; B26F 1/384
See application file for complete search history.

(56) References Cited

U.S. PATENT DOCUMENTS 4,020,724 A * 5/1977 Quinlan ..... B26D 7/2628 493/60
4,693,157 A 9/1987 Looser
2012/0204692 A1* 8/2012 Schurch ..... B21D 28/12 83/100
2012/0216663 A1* 8/2012 Carmichael ..... B26D 1/385 83/349
2017/0312941 A1* 11/2017 Fujimoto ..... B29B 15/122

FOREIGN PATENT DOCUMENTS

EP 0979790 A2 2/2000
GB 985083 A 3/1965

OTHER PUBLICATIONS

Communication dated Oct. 27, 2016, issued from the Spanish Patent and Trademark Office in counterpart Application No. 201531412.

* cited by examiner

*Primary Examiner* — Omar Flores Sanchez
(74) *Attorney, Agent, or Firm* — Sughrue Mion, PLLC

(57) ABSTRACT

A method for obtaining one or more strips from a band material extending in a longitudinal direction (Y), using a cutting die with two cutting edges, there being at least two theoretic cutting start and end points on each one of the cutting edges which determine a predetermined cutting pattern. The cutting edges extend in a cutting line beyond the theoretic cutting start or theoretic cutting end points, or in both, which do not form part of the pattern. The cutting lines have a correcting section extending in a direction that is not parallel to the longitudinal direction (Y), to compensate for a lateral discrepancy between the theoretic cutting start and end points between two consecutive cutting operations.

12 Claims, 4 Drawing Sheets

METHOD FOR OBTAINING ONE OR A NUMBER OF STRIPS OF A BAND MATERIAL AND A CUTTING DIE FOR PUTTING THE METHOD INTO PRACTICE

TECHNICAL SECTOR OF THE INVENTION

The invention relates to a method for obtaining one or a number of strips of a band material which extends in a longitudinal direction using a cutting die which is applied repeatedly in consecutive cutting operations against longitudinally contiguous sections of the band. The invention is applicable to flat dies or to rotary dies.

BACKGROUND OF THE INVENTION

In the field of packaging and more specifically of packaging in net bags, strips of plastic material are used for making the bags which are applied to one side or to the two sides of a net tube and cooperate in order to close the net tube and sometimes contribute to the bags having the required mechanical features.

These strips are obtained by transversally cutting a continuous strip which, in turn, is obtained by longitudinally cutting an initial band. To this end, it is common to unroll the band from a band supply and longitudinally cut it by means of a cutting die which is repeatedly applied against longitudinally contiguous sections of the band. The cutting die can have various cutting edges which, in pairs, determine both strips to be individualized of the initial band.

In the advanced preparation of bags, the strips intended to be used in a bag have a specific design or pattern such that the cutting edge of the die has a particular configuration for giving the strip a shape which follows this specific pattern.

When the die is a rotary die, it is possible to use a die-carrying drum, the exterior circumference of which is adjusted to the length or to a multiple of the length of this pattern. However, this requires the die-carrying drum and the associated die having to be replaced each time that the length of the pattern needs to be changed.

In order to avoid this drawback, replacement cutting dies can be used. These cutting dies can be in the shape of metallic plates which are applied, for example using magnetic attraction forces separately on the exterior surface of a die-carrying drum. Each cutting die will have cutting edges, the length of which will depend on the length of the pattern which is desired to be obtained, which will not necessarily be equal to the perimeter which the die carrier provides. Consequently, it may occur that in the replacement dies, the cutting edges do not turn around the die-carrier completely and that the cutting edge is thus interrupted, there being at least one cutting start point and one cutting end point. The systems which use replacement dies, in which this situation occurs, are enabled for stopping the advance of the band in a cutting operation of the same during the rotation of the die carrier and during the times when there is an interruption to the cutting edge, that is when there is no interference between the cutting edge and the band.

Notwithstanding the foregoing, even though the cutting start and end points of the same cutting edge are aligned on the plate, i.e. they have the same ordinate on a reference coordinate axis, it may occur that they do not spatially match on the band and this means that there is no longer perfect continuity in the cut made in the band.

This discontinuity may be due to the fact that the start-up and stop operations of the band are not perfectly coordinated with the rotation of the die-carrier. In the field of application previous described there are other factors which also contribute to the existence of this discontinuity.

For example, the elastic nature of the material which forms the band can make it very difficult to coordinate these stop and start-up operations because the material may be stretched and delocalize the exact cutting start and end point. At the same time, an imperfect alignment of the cutting die during the installation thereof on the die carrier may also contribute to there being an interruption in the cut made, in this case because it may cause there to be a lateral discrepancy between a cutting end point and a cutting start point which should spatially match with the cutting end point. Other factors such as the maladjustment of the components of the cutting machine or the wearing of the cutting edges may also over time contribute to there being undesired interruptions in the cutting of a band.

These problems are not serious drawbacks when the band material is, for example paper or cardboard or when the thickness of the band largely exceeds the discrepancy between the cutting end and cutting start points. However, these problems of interrupting cutting are more significant when work is carried out with a material in the form of a film or thin sheet, like in the case previously described in terms of the net bags, since they can be the cause for subsequently manufacturing defective bags or for improvable quality and in particular circumstances tearing of the film and causing a stoppage to machinery.

Although today, the appearance of these manufacturing defects was assumed, a method and a cutting die, which solve these drawbacks, is an objective of the present invention.

A solution, which is applicable to flat dies and not only to rotary cutting dies, is also an object of the invention.

DESCRIPTION OF THE INVENTION

The method of the invention is in essence characterized by using a die, the cutting edges of which have been extended beyond the cutting points between which the desired cutting pattern is delimited in cutting lines not belonging to the pattern, which have a very small length in comparison to the length of the pattern, but sufficient to compensate for imperfections or misalignments which may occur during the cutting method.

The method of the invention is suitable for obtaining one strip or a number of strips from a band material which extend in a longitudinal direction (Y) which comprises using a die carrier and a cutting die which has at least two cutting edges of equal length which are repeatedly applied in consecutive cutting operations against longitudinally contiguous sections of the band and cooperate in order to cut two portions of band therebetween which are connected in order to form a continuous strip, there being at least two theoretic cutting start and end points at each one of the cutting edges which determine a predetermined cutting pattern between each other.

In essence, this method is characterized in that a cutting die is used, the cutting edges of which are extended in at least one cutting line beyond the theoretic cutting start or theoretic cutting end points, or in both, and in that said cutting lines comprise a correcting section which extends in a direction that is not parallel to the cited longitudinal direction (Y), said correcting sections of the cutting lines being intended to compensate for a lateral discrepancy between the theoretic cutting start and end points between two consecutive cutting operations caused, for example by an imperfect alignment of the cutting die with respect to the band or with respect to the die carrier, by an unintended deformation of the band or by imprecise positioning of the cutting die on the band.

The cutting edges can have a different cutting profile. Equal length is understood as the distance between the theoretic cutting start and end points A and B being equal or similar since the method strives to obtain one or a number of continuous strips of the band material for which the cuts made in the same in each cutting operation should be connected without there being an interruption to cutting.

In one variant in which the cutting edges follow directions that are parallel to the longitudinal direction (Y) in the sections which lead to the theoretic cutting start and end points, the invention envisages that the cutting lines comprise a first straight section after the associated theoretic cutting point, said first straight section follows the same direction as that of the cutting edge and is intended to compensate for a longitudinal discrepancy between the theoretic cutting points between two consecutive cutting operations.

The correcting section of the cutting lines can be selected from a curved section; a straight section; or a combination of both.

In one embodiment, the cutting lines end in a point separated a distance h with respect to the straight projection, in the longitudinal direction (Y), of the associated theoretic cutting start or end points, in compliance with the relationship $$5\ \text{mm} \geq h \geq 0.2\ \text{mm},$$

a distance h being selected that is a compromise between being able to compensate for the envisaged maximum deviations, while minimizing the residual cuts which may be in the band beyond the intersection between two cutting lines or one cutting line with a cut belonging to the pattern.

In one variant of the method in which the cutting die comprises at least two pairs of cutting edges intended to cut two portions of band between each pair with the interposition of a cutting between said portions of band, the correcting sections of the cutting lines of the cutting edges of the same pair are divergent, i.e. they widen the portion of band that they will cut between them.

In another variant in which the cutting die comprises cutting edges intended to cut two portions of band between each pair without the interposition of a cutting between said portions of band, the correcting sections of the cutting lines of the cutting edges of the same pair are parallel to each other.

In one embodiment of interest, the cutting edges being extended in both cutting lines at the theoretic cutting start and theoretic cutting end points, the correcting sections of the cutting lines are opposing.

In another variant in which the cutting edges follow a direction that is not parallel to the longitudinal direction (Y) in one of the sections which lead to the theoretic cutting start points or theoretic cutting end points, following a direction that is parallel to the longitudinal direction (Y) in the other of the sections which lead to the theoretic cutting start points or to the theoretic cutting end points, the cutting lines of the sections which follow the cited direction that is parallel to the longitudinal direction (Y) only comprise a straight section after the associated theoretic cutting point, said straight section follows the same direction as that of the cutting edge.

The length of the cutting lines can vary but they are preferably greater than 0.5 mm and less than 2 mm.

The invention envisages that the cutting die is a replacement die mounted on a rotary die carrier around a rotation axis arranged transversal to the longitudinal direction (Y) of the band material.

According to another aspect of the invention, a cutting die is proposed, particularly a replacement die, ready to be fixed to a die carrier which has at least two cutting edges of equal length intended to cooperate in order to cut a portion of band of a band material therebetween, there being at each one of the cutting edges at least two theoretic cutting start and cutting end points at the same ordinate with respect to an imaginary coordinate axis and which delimit a predetermined cutting pattern defined by the profile of the cutting edge which is in essence characterized in that the cutting edges extend in a cutting line beyond the theoretic cutting start or theoretic cutting end points or in both, which comprise a correcting section which extends in a direction that is not parallel to the axis of the abscissa of said imaginary coordinate axis, said correcting sections of the cutting lines being intended to compensate for a lateral discrepancy between the theoretic cutting start and end points when the cutting die is applied on the band.

In one variant in which the cutting edges follow directions that are parallel to the axis of the abscissa of the imaginary coordinate axis in the sections which lead to the theoretic cutting start and cutting end points, the cutting lines comprise a first straight section after the associated theoretic cutting point, said first straight section follows the same direction as that of the cutting edge.

The correcting section of the cutting lines can be selected from a curved section; a straight section; or a combination of both.

In one variant, the cutting line ends at a point with an ordinate, the difference h of which with respect to the ordinate of the associated theoretic cutting start or end point follows the relationship:

$$5\ \text{mm} \geq h \geq 0.2\ \text{mm}$$

The correcting sections at the theoretic cutting start, theoretic cutting end points or both can be divergent, convergent or parallel to each other at the cutting edges of the same pair and there being cutting lines at the theoretic cutting start and theoretic cutting end points at the same cutting edge, the corresponding correcting sections can be opposing.

In one variant in which the cutting edges follow a direction that is not parallel to the axis of the abscissa of the imaginary coordinate axis at one of the sections which lead to the theoretic cutting start points or to the theoretic cutting end points, following a direction that is parallel to the abscissa in the other of the sections which lead to the theoretic cutting start points or to the theoretic cutting end points, the cutting lines of the sections which follow the cited direction that is parallel to the abscissa only comprise a straight section after the theoretic cutting point, said straight section follows the same direction as that of the cutting edge.

The length of the cutting lines is preferably greater than 0.5 mm and less than 2 mm.

In another aspect of the invention, a cutting tool is proposed which comprises a die carrier in the shape of a rotary drum and a replacement cutting die according to the invention firmly coupled, but in a separable manner on the surface of the drum of the die carrier, the cutting edges of the cutting die having a length less than that of the exterior perimeter of the drum such that they do not turn around the drum of the die carrier completely.

DETAILED DESCRIPTION OF VARIOUS EMBODIMENTS

Figure 1:
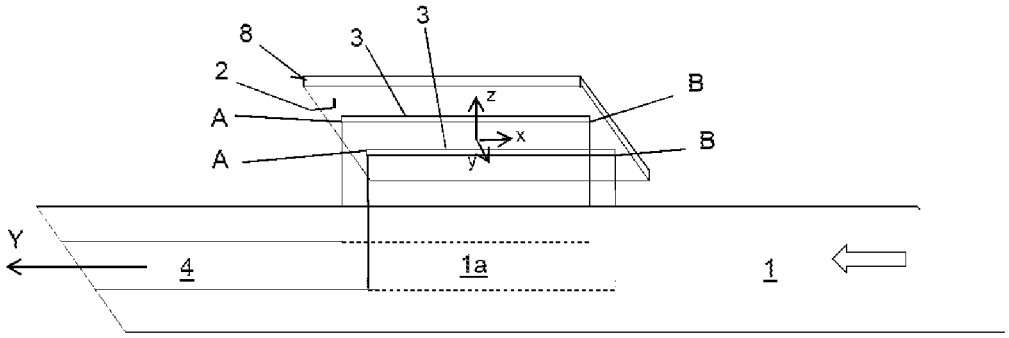
FIG. 1 schematically shows a set of a die carrier and a flat die with two cutting edges of equal length.
Figure 3:
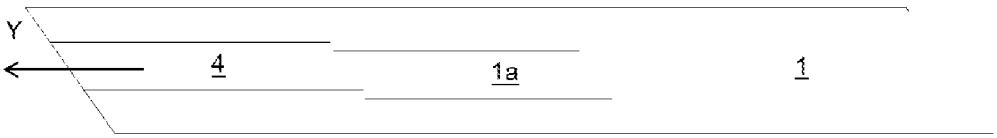
FIG. 3 schematically shows, in an exaggerated manner for better understanding, the interruption of cutting which may occur in a band when, for example there is an imperfect alignment of the cutting die with respect to the band or with respect to the die carrier, when a deformation of the band has been caused, when the displacement of the cutting die with respect to the band has not been coordinated correctly or a combination of the previous situations.

FIG. 1 schematically shows a die carrier 8 which has a simple cutting die 2 with two cutting edges 3 of equal length. Two cutting start points A and two cutting end points B are distinguished on the cutting die 2 which determine a predefined pattern therebetween, said pattern is repeated on the strip 4 which is obtained from the band 1 to be cut when the die is applied on said band 1 in consecutive sections of the same. Although each pair of points A and B of the same cutting edge have the same ordinate with respect to a single imaginary coordinate reference axis shown in FIG. 1, an imperfect alignment of the cutting die 2 on the band 1, stretching of the same or other unintended maladjustments may cause the spatial mismatching of the points A and B on the band 1 during two consecutive cutting operations, causing an interruption in the cuts as is shown in an exaggerated manner in FIG. 3.

Figure 2:
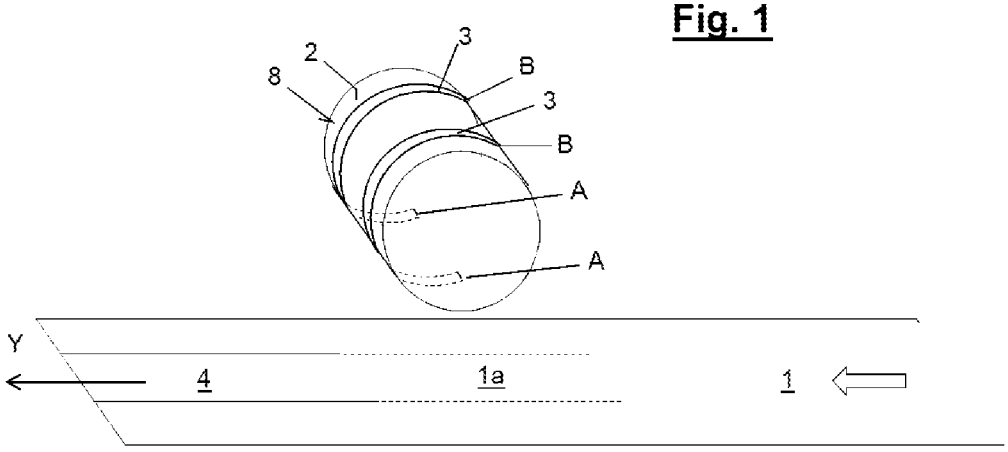
FIG. 2 schematically shows a rotary die carrier on which a die cutter has been arranged with two cutting edges of equal length which do not turn around the die carrier completely.

Similarly, FIG. 2 schematically shows a die carrier 8, this time in the shape of a rotary drum which has a simple cutting die 2, similar to that of FIG. 1, with two cutting edges 3 of equal length. Two cutting start points A and two cutting end points B are distinguished on the cutting die 2 which determine a predefined pattern therebetween said pattern is repeated on the strip 4 which is obtained from the band 1 to be cut when the die is applied on said band 1 rotating such that it impresses on the cutting edges 3 a tangential velocity equal to the advance velocity of the band 1 (the advance of the band 1 being interrupted when there is no interference between the cutting edges 3 and said band 1). Although each pair of points A and B of the same cutting edge have the same ordinate with respect to a single imaginary coordinate reference in an extend position of the cutting die 2, an imperfect alignment of the cutting die 2 on the die carrier 8, stretching of the band 1 or other unintended maladjustments may cause the spatial mismatching of the points A and B on the band 1 during two consecutive cutting operations, causing an interruption in the cuts as is shown in an exaggerated manner in FIG. 3.

The cutting start point A and cutting end point B only match exactly on the band 1 in an ideal cutting scenario, which does not usually take place, for this reason, we refer to them as theoretic cutting start point and theoretic cutting end point. The desired pattern is determined between these theoretic cutting start and theoretic cutting end points A and B.

The invention proposes extending the cutting edges beyond these theoretic cutting start and theoretic cutting end points A and B in two cutting lines 7 which merely provide a correcting function in order to compensate for the malalignments previously explained and as such said cutting lines 7 can have a length of various orders of magnitude less than the length of the cutting edges 3. These cutting lines 7 are thus outside of the cutting pattern and will not be discernable by an uninformed user.

Figure 4:
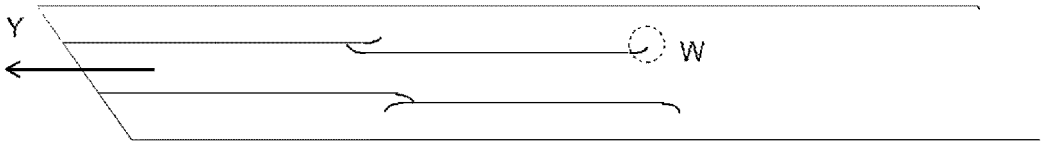
FIG. 4 schematically shows, in an exaggerated manner for better understanding, a solution for compensating for these imperfections of the system and avoiding there being discontinuity in the cut.

FIG. 4 shows the result of extending the cutting edges 3 of the examples of FIGS. 1 and 2 beyond these theoretic cutting start and theoretic cutting end points A and B. Note that there is still no interruption in the cut made in two consecutive cutting operations.

Although in the example of FIG. 4, the result of extending each cutting edge 3 at both theoretic cutting start and theoretic cutting end points A and B is shown, it is envisaged that each cutting edge is extended only at one of the theoretic cutting points A or B thereof. At the same time, as will be explained below, the shape of the cutting line 7 can vary, although in order to compensate for lateral deviations, it will be necessary for the cutting line 7 to comprise at least one correcting section which is directed towards the interior or towards the exterior of the portion of band 1, i.e. in a direction with a component transversal to the band or not parallel to the longitudinal direction Y of the band.

Figure 5A:
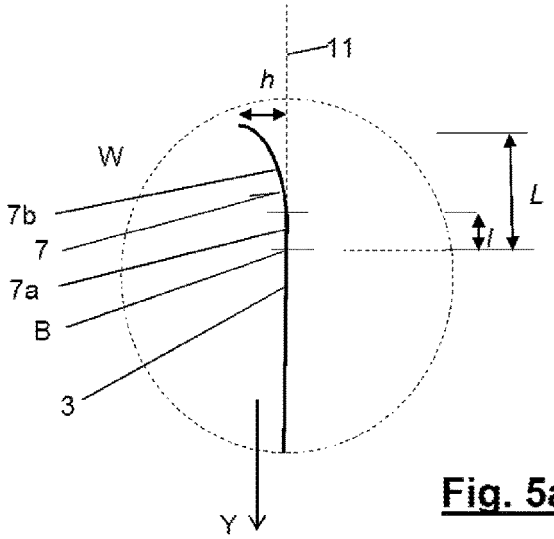
FIG. 5*a* shows a cutting line according to the invention which can be used for giving the area indicated with a W in FIG. 4 a cutting profile suitable for correcting longitudinal and transversal deviations.

FIG. 5*a* shows a possible shape for a cutting line 7 of the type which would be used in the example for cutting the band 1 of FIG. 4. FIG. 5 illustrates the theoretic cutting end point B which delimits the end of the cutting pattern and how the cutting edge 3 has been extended at a first straight section 7*a* which follows the same direction as that of the cutting edge 3 and which is intended to compensate for a longitudinal discrepancy between the theoretic cutting end point B and theoretic cutting start point A of two consecutive cutting operations and, without any break in continuity, said straight section 7*a* connects to a curved correcting section 7*b* intended to compensate for a lateral discrepancy between the cited theoretic cutting end and start points B and A.

In this example, the length l of the straight section 7*a* is 0.5 mm and the correcting section 7*a* would end at a point arranged at a distance L, in the advance direction of the band 1, of 1.5 mm from the theoretic cutting end point B. In order to correct lateral deviations, in the embodiment illustrated, a distance h of 0.5 mm is envisaged. These values proved sufficient for correcting deviations in a method for cutting a band 1 of polyethylene plastic material and a thickness of 80 microns using a replacement cutting die 3 made of steel, mounted on the rotary drum of a cutting machine equipped with a system from the market, for example from the provider Spilker, with start-up and stop control for the advance of the band assisted by servo motors, the cutting die being coupled to the rotary drum or die carrier by means of a conventional magnetic attraction system, the repetitive cutting pattern having a length of 400 mm. Satisfactory results are also obtained with other pattern lengths which use cutting edges, the distances of which between the theoretic cutting start and end points A and B are, for example 400 mm, 800 mm or 1290 mm.

Figure 5B:
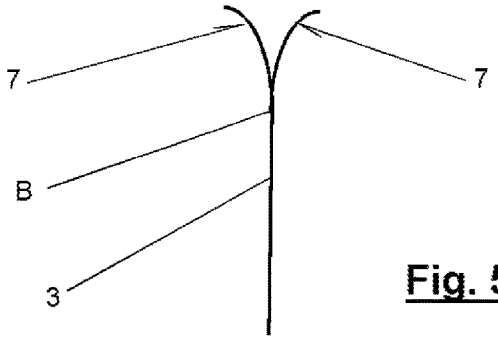
FIG. 5*b* shows a double cutting line also envisaged by the invention, which may be of interest when only one of the theoretic cutting start or end points are extended in this case by means of a double cutting line.

FIG. 5*b* shows an alternative variant in which a cutting edge 3 has been extended in a double cutting line 7 which may be of interest when only one of the theoretic cutting start or end points A or B are extended, in this case by means of a double cutting line.

Figure 6:
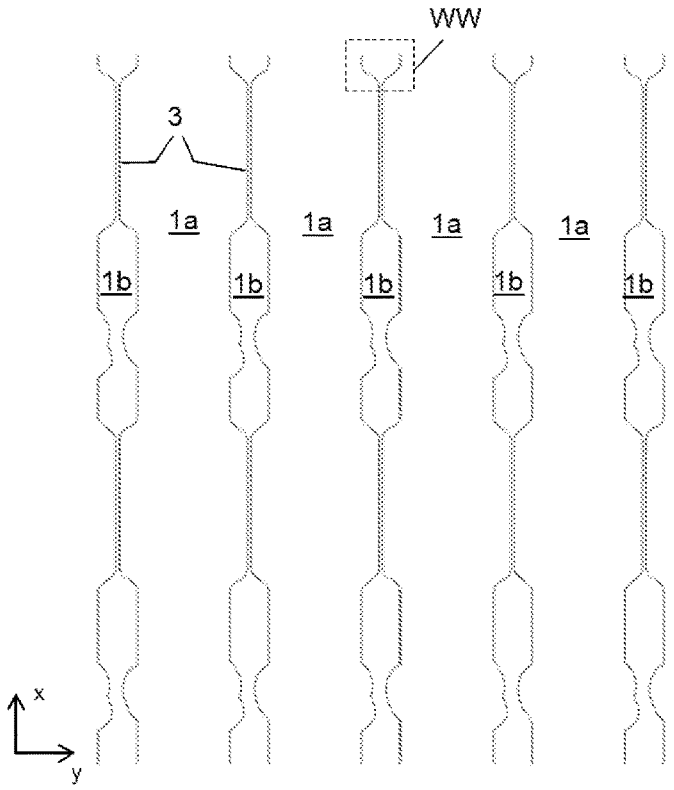
FIG. 6 shows the cutting profile of the cutting edges of a die according to the invention.

FIG. 6 shows part of a cutting die in an extended position according to another variant of the invention. The cutting die comprises a number of pairs of cutting edges 3 (four complete pairs being illustrated) intended to cut two portions of band 1*a* between each pair with the interposition of a cutting 1*b* between said portions of band 1*a*. In this example, the length of the cutting pattern corresponds to 800 mm and in FIG. 7 the area indicated with WW in FIG. 6 has been widened for the purpose of including the actual dimensions of a cutting line 7 in order to put the invention into practice compared to the length of the pattern.

Figure 7:
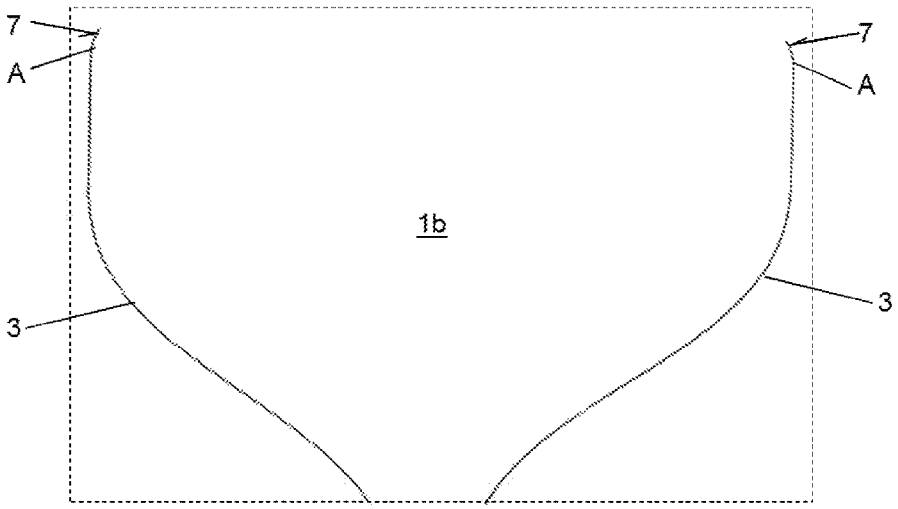
FIG. 7 is a detail expansion of FIG. 6 indicated with WW.

In the examples of FIGS. 6 and 7, the cutting lines are all directed towards the exterior of the portions of band 1*a* delimited by each pair of cutting edges 3. This design of the cutting die is of greater interest when there are cuttings 1*b* between the pairs of cutting edges 3 since the residual cuts 9 (see FIG. 8) which will be on the band 1 beyond the intersection point 10 between the cutting lines 7 (or as the case may be between a cutting line 7 and a cut corresponding to the pattern), which give continuity to the cut, will be made in the cuttings and not in the portions of band 1*a* intended to form the strips of material.

Figure 8:
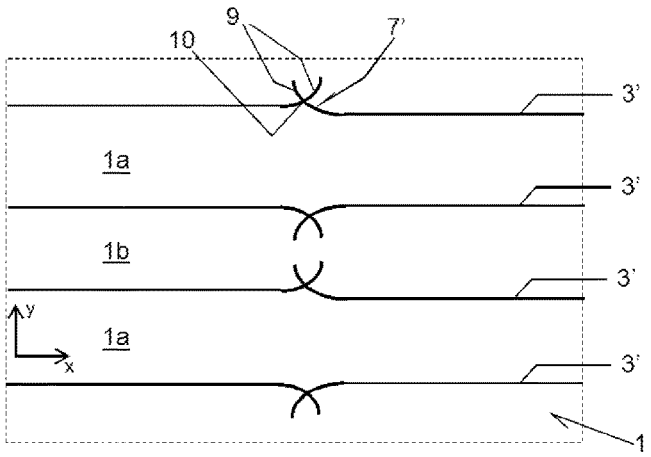
FIG. 8 schematically shows the cutting profile of the cutting edges of another die according to the invention, the cutting lines being illustrated in an exaggerated manner.

FIG. 8 schematically shows the arrangement of the pattern cuts 3' and residual cuts 9 on the part of the band 1 corresponding to the cuttings 1*b* in one embodiment similar to that of FIGS. 6 and 7, the cuts 7', which would be left on the band corresponding to cutting lines, are illustrated exaggeratedly large for better understanding.

Figure 9:
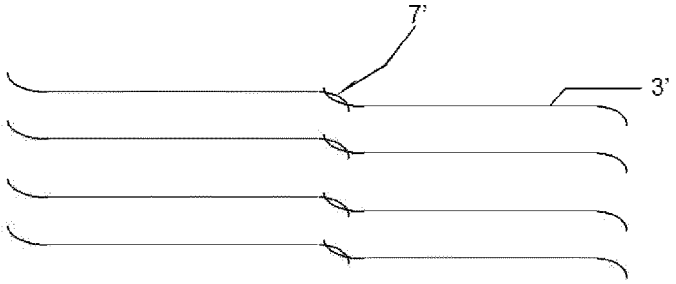
FIG. 9 schematically shows the cutting profile of the cutting edges of another die according to the invention, suitable for obtaining juxtaposed strips without cuttings between the portions of band delimited between each pair of cutting edges, the cutting lines being illustrated in an exaggerated manner.

FIG. 9 schematically shows the profile of the cuts 3' which a cutting die would leave, there being cutting lines at both theoretic cutting start and theoretic cutting end points (which would be reflected by the cutting lines 7' on the band), but in this case opposing. This configuration may be suitable in the case of there not being cuttings between the determined portions of band 1 a between each two cutting edges 3. In this case, it is of interest to reduce as far as possible the length of the cutting lines 7' on the band in order to decrease the length of the possible residual cuts on the portions of band 1*a*.

Figure 10:
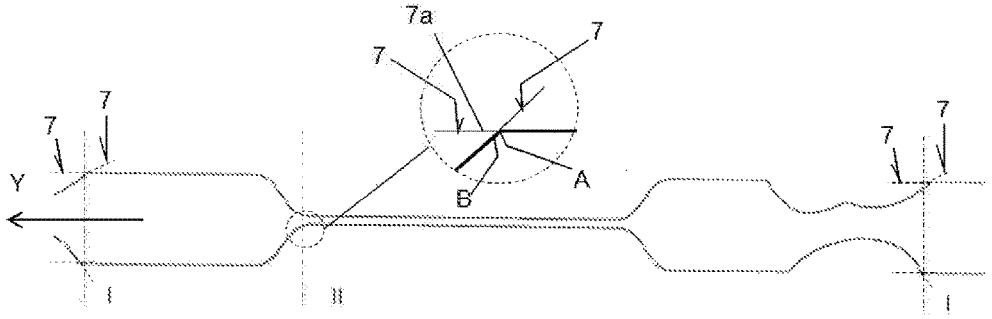
FIG. 10 schematically shows the cutting profile of the cutting edges of another die according to the invention, different options for the cutting lines having been drawn depending on whether the pattern is interrupted at the points I or II, including an expansion of the section within a circumference with discontinuous outlines.

In the example of FIG. 10, the cutting edges 3, in any of the options I and II for interrupting the pattern, follow a direction that is not parallel to the longitudinal direction (Y) in the sections which lead to the theoretic cutting end points, following a direction that is parallel to the longitudinal direction (Y) in the sections which lead to the theoretic cutting start points. In this case, the cutting lines 7 of the sections which follow the cited direction that is parallel to the longitudinal direction (Y) only comprise a straight section 7*a* after the theoretic cutting point, said straight section 7*a* follows the same direction as that of the cutting edge. The cutting lines 7 of the sections which do not follow the cited direction that is parallel to the longitudinal direction (Y) can comprise a straight section 7*a* after the theoretic cutting point, said straight section 7*a* follows the same direction as that of the cutting edge, a curved section or a combination of both depending on the tangential level which the pattern exhibits at this meeting point of theoretic cutting end and theoretic cutting start.

The invention claimed is:

1. A method for obtaining one strip (4) or a number of strips from a band material (1) which extends in a longitudinal direction (Y), comprising using a die carrier (8) and a cutting die (2) which has at least two cutting edges (3) of equal length which are repeatedly applied in consecutive cutting operations against longitudinally contiguous sections of the band and cooperate in order to cut two portions of band (1*a*) therebetween which are connected in order to form a continuous strip (4), there being at least two theoretic cutting start and end points (A, B) on each one of the cutting edges (3) which determine a predetermined cutting pattern between each other, wherein a cutting die (2) is used, the cutting edges (3) of which extend in at least one cutting line (7) beyond the theoretic cutting start point (A) or theoretic cutting end point (B), or in both, and said cutting lines (7) comprise a correcting section (7*b*) which extends in a direction that is not parallel to the cited longitudinal direction (Y), said correcting sections (7*b*) of the cutting lines (7) so as to compensate for a lateral discrepancy between the theoretic cutting start and end points (A) and (B) between two consecutive cutting operations.

2. The method according to claim 1 wherein the cutting edges (3) follow directions that are parallel to the longitudinal direction (Y) in the sections which lead to the theoretic cutting start and end points (A, B), and wherein the cutting lines (7) comprise a first straight section (7*a*) after the associated theoretic cutting point, said first straight section following the same direction as that of the cutting edge (3) and so as to compensate for a longitudinal discrepancy between the theoretic cutting points between two consecutive cutting operations.

3. The method according to claim 1, wherein the correcting section (7*b*) of the cutting lines (7) is selected from a curved section; a straight section; or a combination of both.

4. The method according to claim 1, wherein the cutting lines (7) end at a point separated a distance (h) with respect to the straight projection (11), in the longitudinal direction (Y), of the associated theoretic cutting start or end points (A, B), in compliance with the relationship $$5\ \text{mm} \geq h \geq 0.2\ \text{mm}.$$

5. The method according to claim 1, wherein the cutting die (2) comprises at least two pairs of cutting edges (3) to cut two portions of band (1*a*) between each pair with the interposition of a cutting (1*b*) between said portions of band (1*a*), wherein the correcting sections (7*b*) of the cutting lines (7) of the cutting edges (3) of the same pair are divergent, i.e. they widen the portion of band (1*a*) that they will cut between them.

6. The method according to claim 1, wherein the cutting die (2) comprises cutting edges (3) to cut two portions of band (1*a*) between each pair without the interposition of a cutting between said portions of band, wherein the correcting sections (7*b*) of the cutting lines (7) of the cutting edges (3) of the same pair are parallel to each other.

7. The method according to claim 6, wherein the cutting edges (3) extend in two cutting lines (7) at the theoretic cutting start and theoretic cutting end points (A, B), the correcting sections (7*b*) of the cutting lines (7) being opposing.

8. The method according to claim 1, wherein the cutting edges (3) follow a direction that is not parallel to the longitudinal direction (Y) in one of the sections which lead to the theoretic cutting start points (A) or to theoretic cutting end points (B), following a direction that is parallel to the longitudinal direction (Y) in the other of the sections which lead to the theoretic cutting start points (A) or to the theoretic cutting end points (B), wherein the cutting lines (7) of the sections which follow the cited direction that is parallel to the longitudinal direction (Y) only comprise a straight section (7*a*) after the associated theoretic cutting point (A or B), said straight section following the same direction as that of the cutting edge (3).

9. The method according to claim 1, wherein the length of the cutting lines (7) is equal to or greater than 0.5 mm and less than 2 mm.

10. The method according to claim 1, wherein the cutting die is a replacement die mounted on a die carrier (8) that rotates around a rotation axis arranged transversal to the longitudinal direction (Y) of the band material (1).

11. A continuous strip (4) obtained from a band material (1) according to the method according to claim 1.

12. The method according to claim 1, wherein the lateral discrepancy between the theoretic cutting start and end points between two consecutive cutting operations is caused by an imperfect alignment of the cutting die with respect to the band or with respect to the die carrier, by an unintended deformation of the band or by imprecise positioning of the cutting die on the band.

* * * * *